US007592973B2

(12) United States Patent
Choi

(10) Patent No.: US 7,592,973 B2
(45) Date of Patent: Sep. 22, 2009

(54) METHOD AND APPARATUS FOR DRIVING A PLASMA DISPLAY PANEL

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 786 days.

(21) Appl. No.: 10/860,610

(22) Filed: Jun. 4, 2004

(65) Prior Publication Data

US 2004/0246206 A1 Dec. 9, 2004

(30) Foreign Application Priority Data

Jun. 5, 2003 (KR) ..... 10-2003-0036288

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS 6,937,213 B2 * 8/2005 Iwasa et al. ..... 345/60
6,956,331 B2 * 10/2005 Lee et al. ..... 315/169.1
2003/0030599 A1 * 2/2003 Kim ..... 345/60
2005/0099365 A1 * 5/2005 Lee ..... 345/63

* cited by examiner

*Primary Examiner*—Sumati Lefkowitz
*Assistant Examiner*—Ke Xiao
(74) *Attorney, Agent, or Firm*—Ked & Associates, LLP

(57) ABSTRACT

The present invention relates to a plasma display panel, and more particularly, to an apparatus for driving a plasma display panel and method thereof. The method for driving the PDP according to the present invention includes the steps of: setting a sustain period where a specific voltage is maintained for a predetermined time period between first and second periods whose voltage varies, in the ramp waveform, and supplying the ramp waveform to electrodes. The apparatus for driving the PDP according to the present invention includes an initialization driving circuit for generating a ramp waveform including a sustain period where a specific voltage is maintained for a predetermined time period between first and second periods whose voltage varies and supplying the ramp waveform to electrodes.

10 Claims, 17 Drawing Sheets

METHOD AND APPARATUS FOR DRIVING A PLASMA DISPLAY PANEL

This Nonprovisional application claims priority under 35 U.S.C. § 119(a) from Patent Application No. 10-2003-0036288 filed in Korea on Jun. 5, 2003, the entire contents of which are hereby incorporated by reference.

BACKGROUND OF THE INVENTION

1. Field of the Invention

The present invention relates to a plasma display panel, and more particularly, to a method and an apparatus for driving a plasma display panel.

2. Description of the Background Art

A plasma display panel (hereinafter, referred to as a 'PDP') is adapted to display an image by light-emitting phosphors with ultraviolet generated during the discharge of a gas such as He+Xe, Ne+Xe or He+Ne+Xe. This PDP can be easily made thin and large, and it can provide greatly increased image quality with the recent development of the relevant technology. Particularly, a three-electrode AC surface discharge type PDP has advantages of lower driving voltage and longer product lifespan as a wall charge is accumulated on a surface in discharging and electrodes are protected from sputtering caused by discharging.

Referring to FIGS. 1 and 2, a three-electrode AC surface discharge type PDP includes scan electrodes Y1 to Yn and a sustain electrode Z which are formed on the bottom surface of an upper substrate 10, and address electrodes X1 to Xm formed on a lower substrate 18.

Discharge cells of the PDP are formed at the intersections of the scan electrodes Y1 to Yn, the sustain electrodes Z and the address electrodes X1 to Xm.

Each of the scan electrodes Y1 to Yn and the sustain electrode Z include a transparent electrode 12, and a metal bus electrode 11 which has a line width smaller than that of the transparent electrode 12, and is disposed at one side edge of the transparent electrode. The transparent electrode 12, which is generally made of ITO (indium tin oxide), is formed on the bottom surface of the upper substrate 10. The metal bus electrode 11, which is generally made of metal, is formed on the transparent electrode 12, and serves to reduce a voltage drop caused by the transparent electrode 12 having high resistance. On the bottom surface of the upper substrate 10 in which the scan electrodes Y1 to Yn and the sustain electrode Z are placed parallel with each other is laminated an upper dielectric layer 13 and a protective layer 14. On the upper dielectric layer 13 are accumulated wall charges generated during plasma discharging. The protective layer 14 is adapted to protect the electrodes Y1 to Yn and Z, and the upper dielectric layer 13 from sputtering generated during plasma discharge, and improve efficiency of secondary electron emission. As the protective layer 14, magnesium oxide (MgO) is generally used.

The address electrodes X1 to Xm are formed on the lower substrate 18 in the direction in which they intersect the scan electrode Y1 to Yn and the sustain electrode Z. A lower dielectric layer 17 and a barrier rib 15 are formed on the lower substrate 18. A phosphor layer 16 is formed on the lower dielectric layer 17 and the barrier rib 15. The barrier rib 15 is formed in parallel with the address electrodes X1 to Xm to physically divide the discharge cells, thus precluding electrical and optical interference among neighboring discharge cells 1. The phosphor layer 16 is excited with an ultraviolet generated during the plasma discharging to generate any one visible light of red, green and blue lights.

Inert mixed gases such He+Xe, Ne+Xe and He+Ne+Xe are injected into the discharge spaces of the discharge cells defined between the upper substrate 10 and the barrier ribs 15 as well as between the lower substrate 18 and the barrier rib 15.

This three-electrode AC surface discharge type PDP is driven with one frame being divided into a plurality of sub-fields having a different frequency of emission in order to implement a gray scale of an image and is driven. If it is desired to display an image with 256 gray scales, a frame period (16.67 ms) corresponding to 1/60 seconds is divided into eight sub-fields SF1 to SF8, as shown in FIG. 3. Each of the sub-fields SF1 to SF8 includes a reset period for initializing the discharge cells 1, an address period for selecting the discharge cells, and a sustain period for implementing a gray scale depending on the frequency of discharging. The reset period and the address period of each of the sub-fields SF1 to SF8 are the same every sub-field, whereas the sustain period and the frequency of its discharging number are increased in the ratio of $2^n$ (where, n=0, 1, 2, 3, 4, 5, 6, 7) in each sub-field.

FIG. 4 shows a driving waveform of a PDP.

Referring to FIG. 4, in a set-up period SU of a reset period, a ramp-up waveform Ramp-up is simultaneously applied to all the scan electrodes Y and at the same time 0V is applied to the sustain electrode Z and the address electrode X. A setup discharge occurs as a weak discharge between the scan electrode Y and the address electrode X as well as between the scan electrode Y and the sustain electrode Z within cells of the entire screen due to the ramp-up waveform Ramp-up. Due to the setup discharge, wall charges of the positive polarity (+) are accumulated on the address electrode X and the sustain electrode Z and wall charges of the negative polarity (−) are accumulated on the scan electrode Y.

In a set-down period SD of the reset period, a ramp-down waveform Ramp-dn whose voltage starts falling approximately from a sustain voltage Vs to the ground voltage GND or 0V is supplied to the scan electrodes Y at the same time. While the ramp-down waveform Ramp-dn is supplied to the scan electrodes Y, the sustain voltage Vs of the positive polarity is supplied to the sustain electrode Z and 0V is supplied to the address electrode X.

As such, if the ramp-down waveform Ramp-dn is supplied, a set-down discharge occurs as a weak discharge between the scan electrode Y and the sustain electrode Z as well as between the scan electrode Y and the address electrode X. Excessive wall charges that are not required for an address discharge, among the wall charges formed during the setup discharge are erased by means of the set-down discharge. Variation in the wall charges during the reset period will now be described. It was found that variation in the wall charges on the address electrode X rarely occurs, and the wall charges of the negative polarity (−) on the scan electrode Y that was formed during the setup discharge are partially erased by the set-down discharge. On the contrary, the wall charges of the positive polarity are formed on the sustain electrode Z during the setup discharge, but the wall charges of the negative polarity are accumulated on the sustain electrode Z as the wall charges of the negative polarity are accumulated thereon as much as the reduction amount of the wall charges of the negative polarity on the scan electrode Y.

In an address period, a scan pulse scan of the negative polarity is sequentially applied to the scan electrodes Y, and simultaneously a data pulse data of the positive polarity is supplied to the address electrodes X in synchronism with the scan pulse scan. As a voltage difference between the scan pulse scan and the data pulse data and a wall voltage generated in the reset period are added, an address discharge occurs in on-cells to which the data pulse data is supplied. Wall charges are formed in on-cells selected by the address discharge to the extent of generating a discharge when the sustain voltage Vs is applied. During the address period, a DC voltage Zdc of the positive polarity is applied to the sustain electrode Z.

In a sustain period, the sustain pulse sus is alternately applied to the scan electrodes Y and the sustain electrodes Z. In the on-cells selected by the address discharge, as the wall voltage and the sustain pulse sus within the cells are added, a sustain discharge, i.e., a display discharge occurs between the scan electrode Y and the sustain electrode Z whenever the sustain pulse sus is supplied.

The sustain discharge is followed by an erase period. In the erase period, an erase ramp waveform ramp-ers whose pulse width and voltage level are small is supplied to the sustain electrode Z, so that the wall charges remaining in the cells of the entire screen are erased.

As in the driving waveform shown in FIG. 4, if the voltage of the ramp-down waveform Ramp-dn falls down to only 0V, an erase operation wherein wall charges on the upper substrate that are required for the address discharge uniformly remain in all the discharge cells cannot be properly performed. For this reason, there was proposed a method wherein a voltage of the ramp-down waveform Ramp-dn is lowered to a voltage of the negative polarity, so that an erase discharge can be performed sufficiently and uniformly in all the discharge cells 1 as shown in FIG. 5.

As the PDP makes it difficult to control the wall charges of the reset period and has a high voltage of the ramp waveform, a setup discharge and set-down discharge of the reset period occur relatively high. Thus there is problem that contrast characteristic is poor. In a conventional method for driving a PDP, a ramp waveform for initializing the PDP has to be set differently depending on a cell condition and a driving condition of each PDP. For example, a slope, a voltage, etc. have to be set differently. Therefore, if a new PDP having a different cell condition and driving condition is developed, a voltage of a ramp waveform, a slope and the like have to be decided through lots of experiences.

Resolution of the PDP has been increased and the image quality of the PDP has been significantly improved. If subfields are added in order to increase resolution or the image quality as such, an address driving time is lengthened, which makes a driving time run short. Such shortage of the driving time can be solved through a dual scan method wherein two lines in the PDP are scanned at the same time. In this case, however, there is a problem that a drive integrated circuit has to be added due to the dual scan method. Accordingly, research on a method circuit has recently been made actively in which the image quality can be improved while driving a PDP in a single scan mode without using additional drive integrated.

Furthermore, for higher efficiency of the PDP, a method has recently been proposed in which Xe content is increased by over 10% in a discharge gas. If Xe content is increased as such, the ramp voltage in the reset period is increased and discharge delay, particularly an address jitter value is increased, which results in an increase in a scan time and an address period. It is thus impossible to drive a PDP in a single scan, a driving margin becomes narrow and a sustain operation becomes unstable.

SUMMARY OF THE INVENTION

Accordingly, an object of the present invention is to solve at least the problems and disadvantages of the background art.

An object of the present invention is to provide a method for driving a PDP and apparatus thereof, wherein erroneous discharge due to temporary voltage drop is prevented, and low-voltage driving and contrast properties are increased.

According to an aspect of the present invention, a method for driving a plasma display panel wherein a cell is initialized by a ramp waveform, comprises the steps of: setting a sustain period where a specific voltage is maintained for a predetermined time period between first and second periods whose voltage varies, in the ramp waveform; and supplying the ramp waveform to electrodes.

According to other aspect of the present invention, a method for driving a plasma display panel wherein a cell is initialized by a ramp waveform, comprises the steps of: supplying a ramp waveform having a sustain period where a specific voltage is maintained for a predetermined time period between first and second periods whose voltage varies, to a first electrode; and supplying an initializing voltage to a second electrode and changing a voltage of the second electrode during the sustain period.

According to an aspect of the present invention, an apparatus for driving a plasma display panel wherein a cell is initialized by a ramp waveform, comprises: an initialization driving circuit for generating a ramp waveform including a sustain period where a specific voltage is maintained for a predetermined time period between first and second periods whose voltage varies and supplying the ramp waveform to electrodes.

According to other aspect of the present invention, an apparatus for driving a plasma display panel wherein a cell is initialized by a ramp waveform, comprises: a first initialization driving circuit for supplying a ramp waveform having a sustain period where a specific voltage is maintained for a predetermined time period between first and second periods whose voltage varies, to a first electrode; and a second initialization driving circuit for supplying an initializing voltage to a second electrode and changing a voltage of the second electrode during the sustain period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
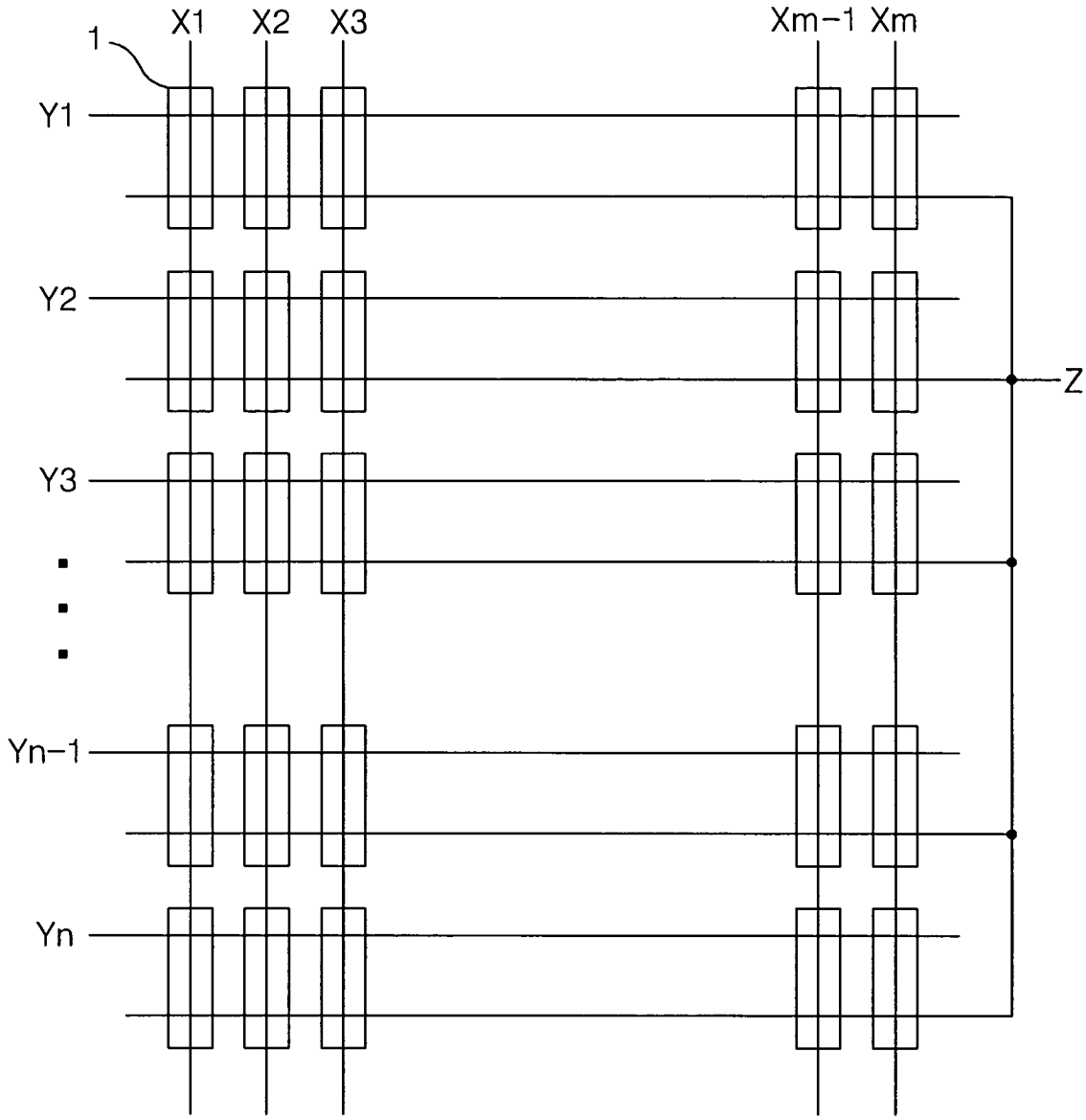
FIG. 1 is a plan view schematically showing arrangements of electrodes in a conventional three-electrode AC surface discharge type plasma display panel.
Figure 2:
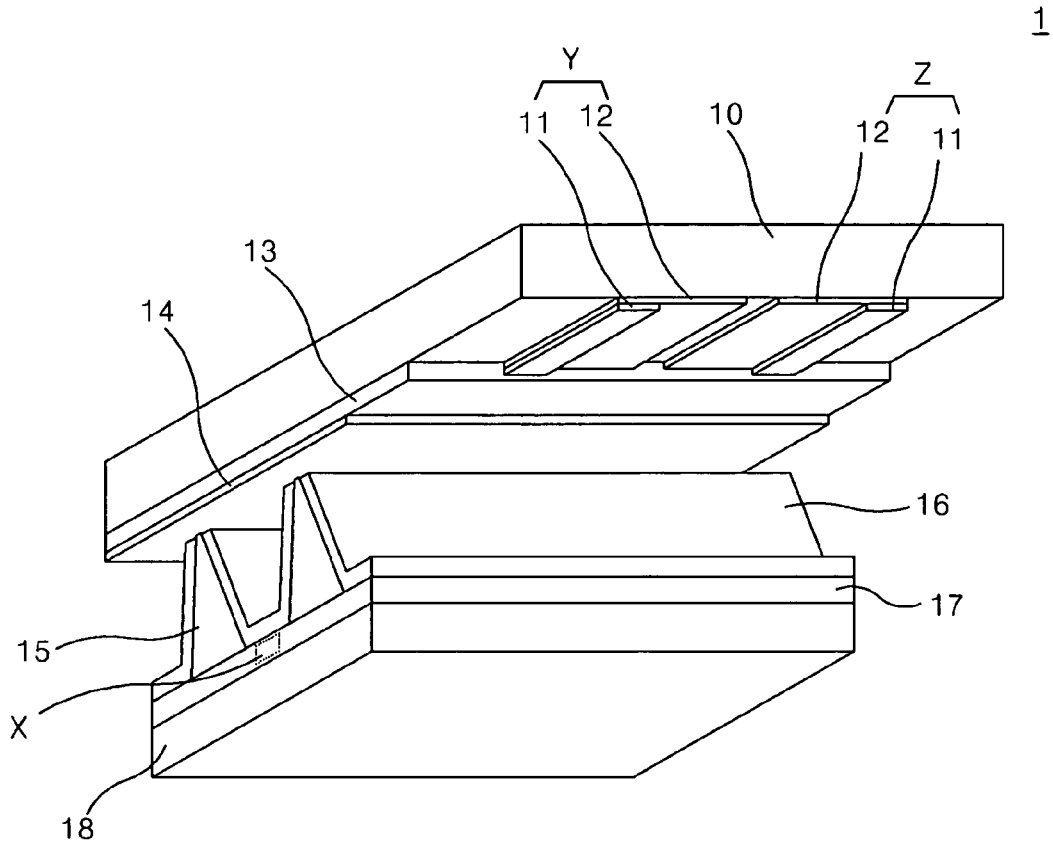
FIG. 2 is a perspective view showing a detailed structure of the discharge cell shown in FIG. 1.
Figure 3:
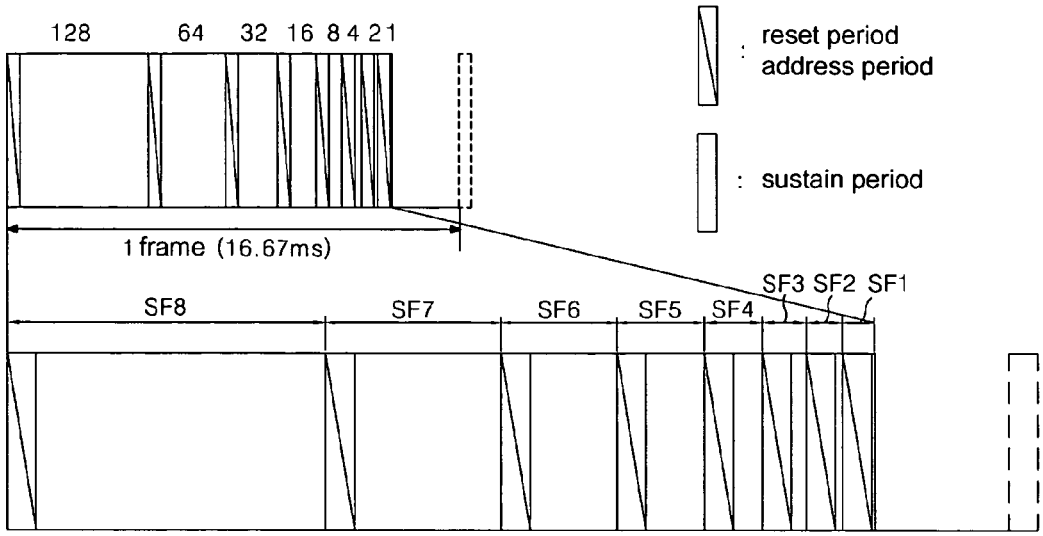
FIG. 3 shows one frame wherein eight sub-fields are included in a conventional method for driving a plasma display panel.

According to an aspect of the present invention, a method for driving a plasma display panel wherein a cell is initialized by a ramp waveform, comprises the steps of: setting a sustain period where a specific voltage is maintained for a predetermined time period between first and second periods whose voltage varies, in the ramp waveform; and supplying the ramp waveform to electrodes.

The specific voltage is a ground voltage GND.

The ramp waveform has a voltage that falls from a voltage of the positive polarity to a voltage of the negative polarity via the ground voltage GND.

The specific voltage is a voltage between the voltage of the positive polarity and the voltage of the negative polarity.

The method further comprises the steps of: supplying a first ramp-up waveform whose voltage rises to a first electrode during a first period of a reset period; supplying a second ramp-up waveform whose voltage rises to a second electrode and at the same time, supplying a ramp waveform including the sustain period to the first electrode during a second period of the reset period; and supplying a second ramp-down waveform whose voltage falls to the second electrode during a third period of the reset period.

According to other aspect of the present invention, a method for driving a plasma display panel wherein a cell is initialized by a ramp waveform, comprises the steps of: supplying a ramp waveform having a sustain period where a specific voltage is maintained for a predetermined time period between first and second periods whose voltage varies, to a first electrode; and supplying an initializing voltage to a second electrode and changing a voltage of the second electrode during the sustain period.

According to an aspect of the present invention, an apparatus for driving a plasma display panel wherein a cell is initialized by a ramp waveform, comprises: an initialization driving circuit for generating a ramp waveform including a sustain period where a specific voltage is maintained for a predetermined time period between first and second periods whose voltage varies and supplying the ramp waveform to electrodes.

The specific voltage is a ground voltage GND.

The ramp waveform has a voltage that falls from a voltage of the positive polarity to a voltage of the negative polarity via the ground voltage GND.

The specific voltage is a voltage between the voltage of the positive polarity and the voltage of the negative polarity.

The initialization driving circuit supplies a first ramp-up waveform whose voltage rises to a first electrode during a first period of a reset period, supplies a second ramp-up waveform whose voltage rises to a second electrode and at the same time supplies a first ramp-down waveform whose voltage falls to the first electrode during a second period of the reset period, and supplies a second ramp-down waveform whose voltage falls to the second electrode during a third period of the reset period.

According to other aspect of the present invention, an apparatus for driving a plasma display panel wherein a cell is initialized by a ramp waveform, comprises: a first initialization driving circuit for supplying a ramp waveform having a sustain period where a specific voltage is maintained for a predetermined time period between first and second periods whose voltage varies, to a first electrode; and a second initialization driving circuit for supplying an initializing voltage to a second electrode and changing a voltage of the second electrode during the sustain period.

Preferred embodiments of the present invention will be described in a more detailed manner with reference to the accompanying FIG. 6 to FIG. 20.

Figure 6:
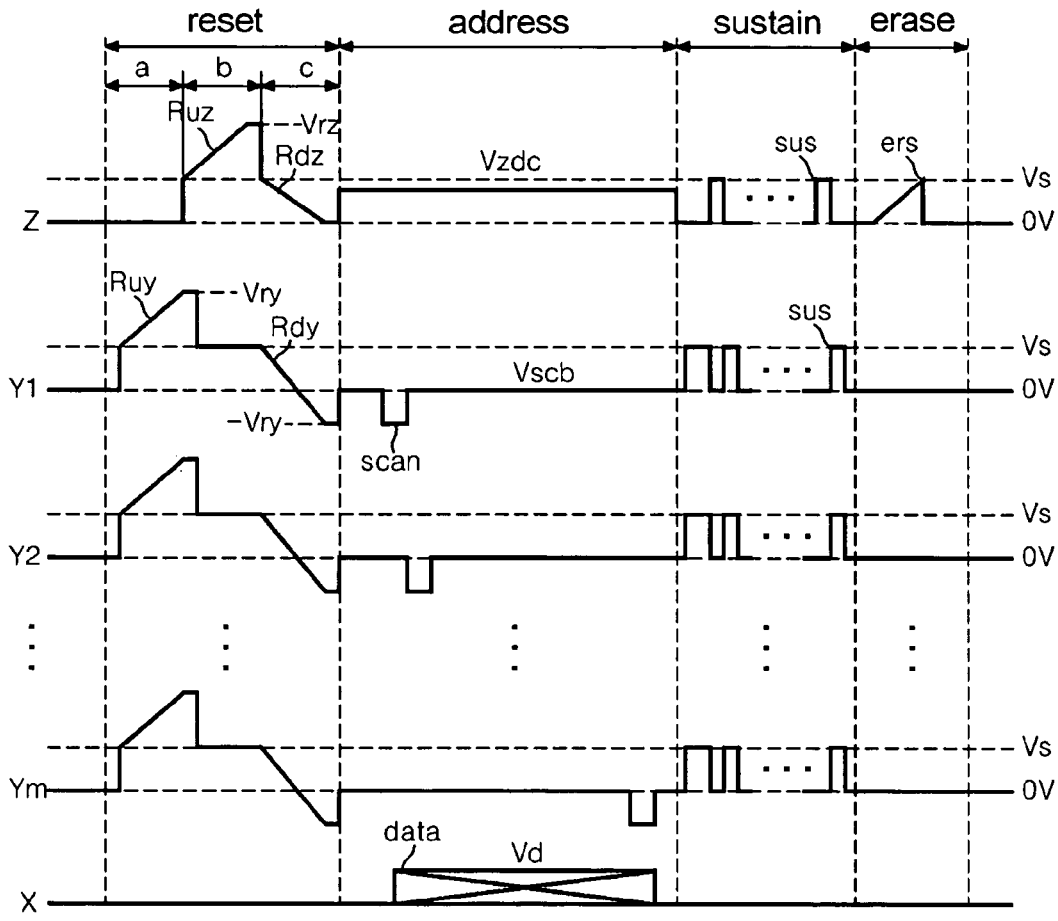
FIG. 6 shows a waveform diagram illustrating a method for driving a plasma display panel according to a first embodiment of the present invention.

FIG. 6 shows a waveform diagram illustrating a method for driving a plasma display panel according to a first embodiment of the present invention.

In a method for driving a PDP according to an embodiment of the present invention PDP, one frame period is time-divided into a plurality of sub-fields each including a reset period for initializing discharge cells of the whole screen, an address period for selecting off-cells, and a sustain period for generating a sustain discharge in on-cells where an address discharge is not generated, and is then driven. At least one of the plurality of the sub-fields is driven by a driving waveform as shown in FIG. 6.

Figure 7:
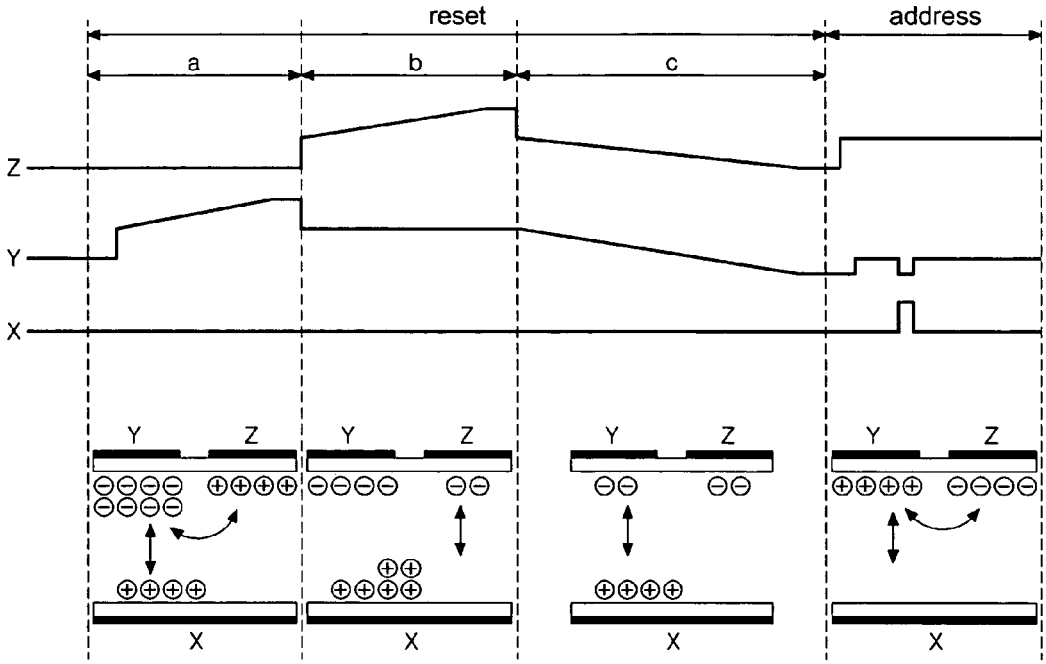
FIG. 7 schematically shows a variation in distribution of wall charges when initialization waveforms shown in FIG. 6 are applied to the plasma display panel.

Referring to FIG. 6 and FIG. 7, in the method for driving the PDP according to an embodiment of the present invention, during a reset period, ramp-up waveforms Ruy and Ruz are sequentially supplied to the scan electrodes Y and the sustain electrodes Z.

In an "a" period of the reset period, the first ramp-up waveform Ruy whose voltage starts rising approximately from a sustain voltage Vs and rises up to a setup voltage Vry is simultaneously supplied to all the scan electrodes Y. At the same time, 0V is applied to the sustain electrode Z and the address electrode X. The "a" period is a period where wall charges are accumulated on the electrodes Y and Z in the upper substrate and the address electrodes X in the lower substrate. A weak discharge occurs between the scan electrode Y and the address electrode X and between the scan electrode Y and the sustain electrode Z within cells of the entire screen by means of the first ramp-up waveform Ruy.

Due to the discharge, wall charges of the positive polarity (+) are accumulated on the address electrode X and the sustain electrode Z and wall charges of the negative polarity (−) are accumulated on the scan electrode Y.

In a "b" period of the reset period, the second ramp-up waveform Ruz whose voltage begins rising approximately from the sustain voltage Vs and rises up to a setup voltage Vrz is applied to the sustain electrodes Z. During this "b" period, the sustain voltage Vs is supplied to the scan electrodes Y and 0V is supplied to the address electrode X. The "b" period is a period where some of the wall charges accumulated on the electrodes Y and Z in the upper substrate are erased and more wall charges are accumulated on the address electrodes X in the lower substrate. A weak discharge occurs between the sustain electrode Z and the address electrode X and between the scan electrode Y and the sustain electrode Z within cells of the entire screen by means of the second ramp-up waveform Ruz. At this time, by means of the discharge between the sustain electrode Z and the scan electrode Y, the wall charges of the negative polarity on the scan electrode Y are erased, and the wall charges of the negative polarity are also accumulated on the sustain electrode Z as much as the amount that is reduced in the wall charges of the negative polarity in the scan electrode Y. As a result, the wall charges of the positive polarity are erased and the polarity of the wall charges is inverted to the negative polarity. Furthermore, by means of the discharge between the sustain electrode Z and the address electrode X, the wall charges of the positive polarity are further accumulated on the address electrode X as much as the amount that the wall charges of the positive polarity accumulated on the sustain electrode Z are reduced.

Figure 4:
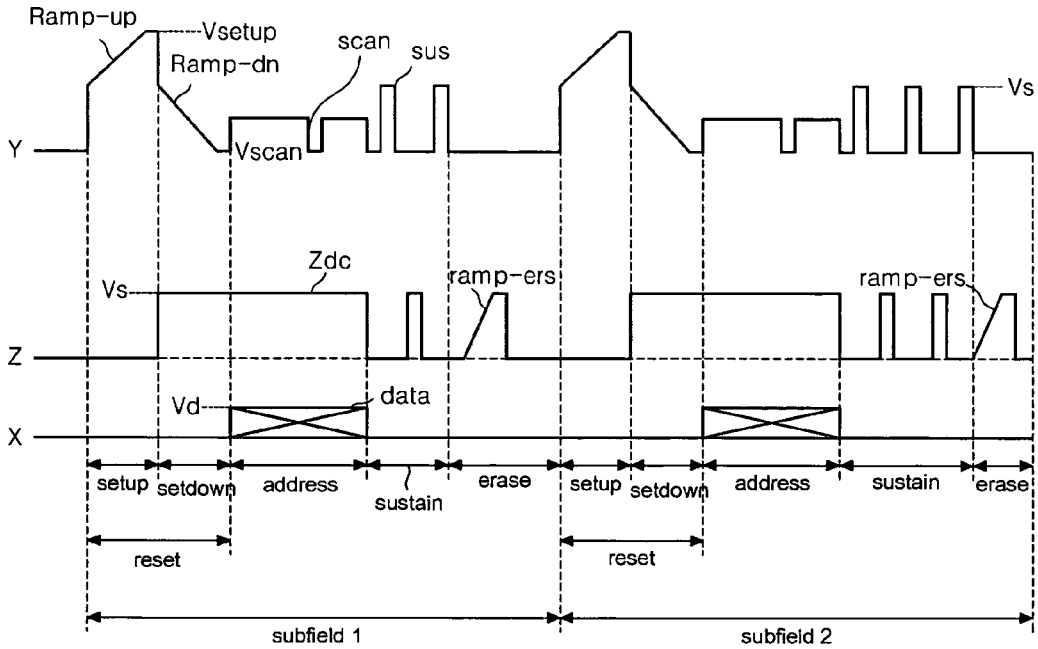
FIG. 4 shows a waveform diagram showing a conventional driving waveform.
Figure 5:
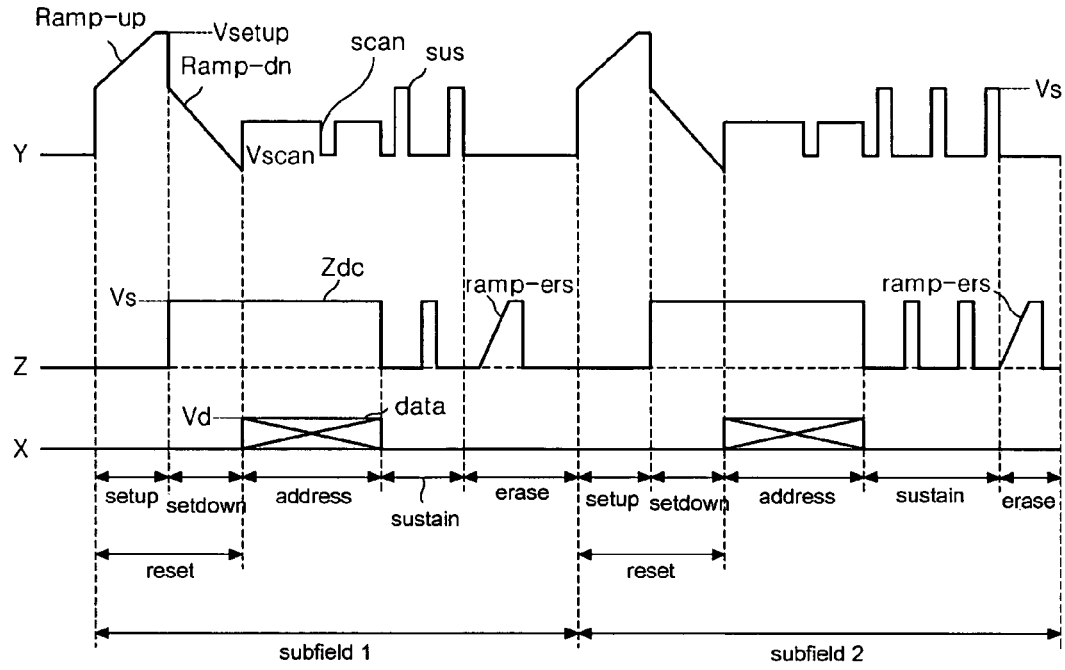
FIG. 5 shows a waveform diagram showing another conventional driving waveform.

In the conventional driving waveforms as shown in FIG. 4 and FIG. 5, if the amount of the wall charges of the positive polarity that are introduced into the lower substrate among charged particles generated in the set-up period SU where the ramp-up signal Ramp-up is applied to the scan electrode Y is small, loss of the wall charges of the positive polarity on the lower substrate due to erasure of the wall charges during a subsequent set-down period SD becomes high enough to make the address discharge unstable. That is, as the wall charges of the lower substrate become short during the address period by the conventional driving waveform, the delay amount of the address discharge or the address jitter becomes high. For this reason, in the method for driving the PDP according to the present invention PDP, the ramp-up waveform Ruy is applied to the scan electrodes Y during the "a" period and the ramp-up waveform Ruz is then applied to the sustain electrodes Z during the "b" period, so that the wall charges of the positive polarity are consecutively supplied to the lower substrate through the twice consecutive discharges.

In this case, the discharge in the "a" period is smaller than by the conventional set-up waveform. Even though the wall charges of the positive polarity formed on the lower substrate in the "a" period is small, the wall charges of the positive polarity are supplemented on the lower substrate by means of the discharge occurring in the "b" period. Owing to this, the voltages Vry and Vrz of the ramp-up waveforms Ruy and Ruz can be lower than the conventional setup voltage Vsetup as shown in FIG. 4 and FIG. 5. Resultantly, since the discharge in the "a" period and the "b" period occurs weakly, contrast characteristics can be improved. As such, even if the ramp voltages Vry and Vrz become lower than the conventional ramp voltage Vsetup, a sufficient amount of the wall charges of the positive polarity can be accumulated on the lower substrate. It is thus possible to reduce discharge delay in a subsequent address discharge.

Meanwhile, the voltages Vry and Vrz of the first and second ramp-up waveforms Ruy and Ruz can be set same or different. Moreover, the slopes of the first and second ramp-up waveforms Ruy and Ruz can be set same or different.

In a "c" period of the reset period, the second ramp-down waveform Rdz whose voltage starts falling approximately from the sustain voltage Vs and falls to the ground voltage GND or 0V is supplied to the sustain electrodes Y and at the same time, a first ramp-down waveform Rdy whose voltage starts falling approximately from the sustain voltage Vs and then falls to a specific voltage −Vny of the negative polarity is provided to the scan electrodes Y. While the ramp-down waveforms Rdz and Rdy are supplied to the sustain electrodes Z and the scan electrodes Y, the address electrodes X are supplied with 0V. When the ramp-down waveforms Rdz and Rdy are supplied as such, a weak discharge occurs between the scan electrodes Y and the address electrodes X. Excessive wall charges that are not required for the address discharge among the wall charges formed on the scan electrodes Y and the address electrodes X are erased from all the discharge cells by means of the discharge.

Meanwhile, the voltages Vry and Vrz of the first and second ramp-down waveforms Rdy and Rdz can be set same or different. Moreover, the slopes of the first and second ramp-down waveforms Rdy and Rdz can be set same or different.

By means of the conventional driving waveform as shown in FIG. 4 and FIG. 5, a surface discharge is usually generated between the scan electrodes Y and the sustain electrodes Z during the set-down period SD, thus controlling the wall charges of the upper substrate and the lower substrate to meet the address condition. On the contrary, in the method for driving the PDP according to the present invention PDP, during the "c" period, only an opposite discharge between the scan electrodes Y and the address electrodes X is used to control the wall charges. It is thus easy to control the wall charges necessary for the address discharge, thus properly controlling the −Vny voltage. Thus, the address initial condition can be ideally set by properly erasing the wall charges related to the address discharge. Furthermore, the present invention can increase the address driving margin and reduce address discharge delay by implementing an ideal initial condition required for the address discharge.

In the address period, the scan pulse scan of the negative polarity scan voltage −Vy is sequentially supplied to the scan electrodes Y, and the data pulse data of the positive polarity data voltage Vd synchronized to the scan pulse scan is supplied to the address electrodes X at the same time. As a voltage difference between the scan pulse scan and the data pulse data and a wall voltage generated during the reset period are added, an address discharge occurs within cells to which the data pulse data is supplied. Wall charges small enough to generate a discharge when the sustain voltage Vs is supplied are formed within the cells selected by the address discharge. During the address period, the DC voltage Vzdc of the positive polarity is supplied to the sustain electrode Z.

In the conventional driving waveform, the DC voltage Zdc supplied to the sustain electrodes Z during the address period is set to the sustain voltage Vs, as can be clearly seen from FIG. 4 and FIG. 5, and is used to allow the wall charges of the negative polarity to be accumulated on the sustain electrodes Z stably. On the contrary, according to the method for driving the PDP of the present invention, in case of the DC voltage Vzdc supplied to the sustain electrodes Z during the address period, sufficient wall charges of the negative polarity are accumulated on the sustain electrodes Z due to the discharge occurring by means of the ramp-up waveform Ruz applied in the "b" period. Thus, it has the same function as the conventional DC voltage Zdc set to the sustain voltage Vs and can be further lowered. That is, according to the method for driving the PDP of the present invention, the voltage of the DC voltage Vzdc supplied to the sustain electrodes Z during the address period can be made lower than the sustain voltage Vs.

In the sustain period, the sustain pulse sus of the sustain voltage Vs is alternately applied to the scan electrodes Y and the sustain electrodes Z. In case of on-cells selected by the address discharge, as the wall voltage and the sustain pulse sus within the cells are added, a sustain discharge occurs between the scan electrode Y and the sustain electrode Z whenever each sustain pulse sus is supplied.

In an erase period following the sustain discharge, an erase ramp waveform ers whose voltage rises from 0V or the ground voltage GND to the sustain voltage Vs at a predetermined slope is supplied to the sustain electrodes Z at the same time, thus erasing wall charges remaining in the cells of the entire screen.

Figure 8:
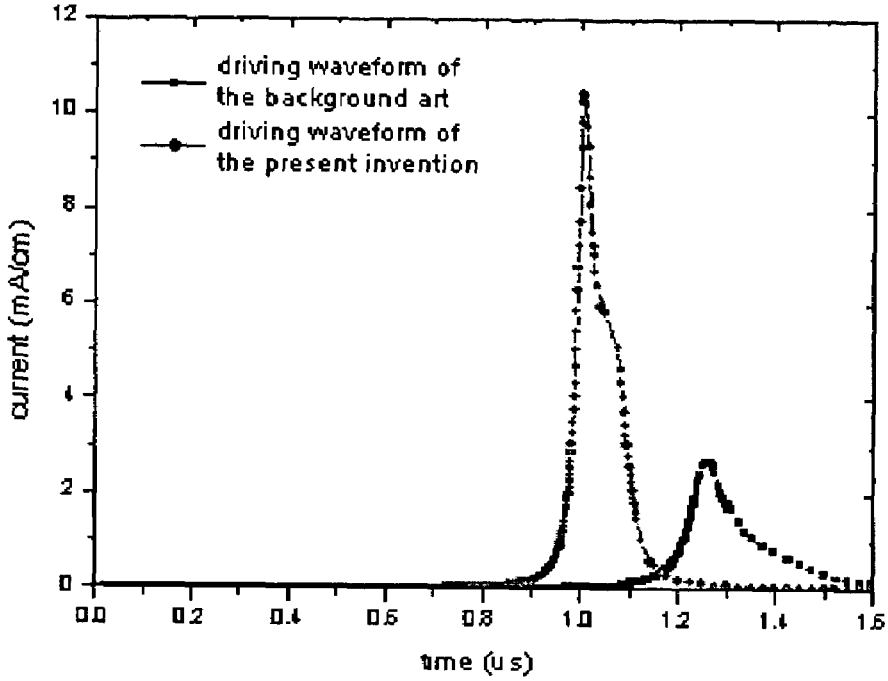
FIG. 8 and FIG. 9 show simulation results when the plasma display panel is driven using the conventional driving waveform and the driving waveform of the present invention.

FIG. 8 shows a simulation result representing a discharge current when an address discharge occurs if a three-electrode AC surface discharge type PDP is driven by the conventional driving waveform as shown in FIG. 4 and FIG. 5 and the driving waveform of the present invention as shown in FIG. 6. It can be clearly seen from FIG. 8 that the discharge occurs rapidly and strongly when the PDP is driven using the driving waveform according to the present invention compared to the conventional driving waveform.

Figure 9:
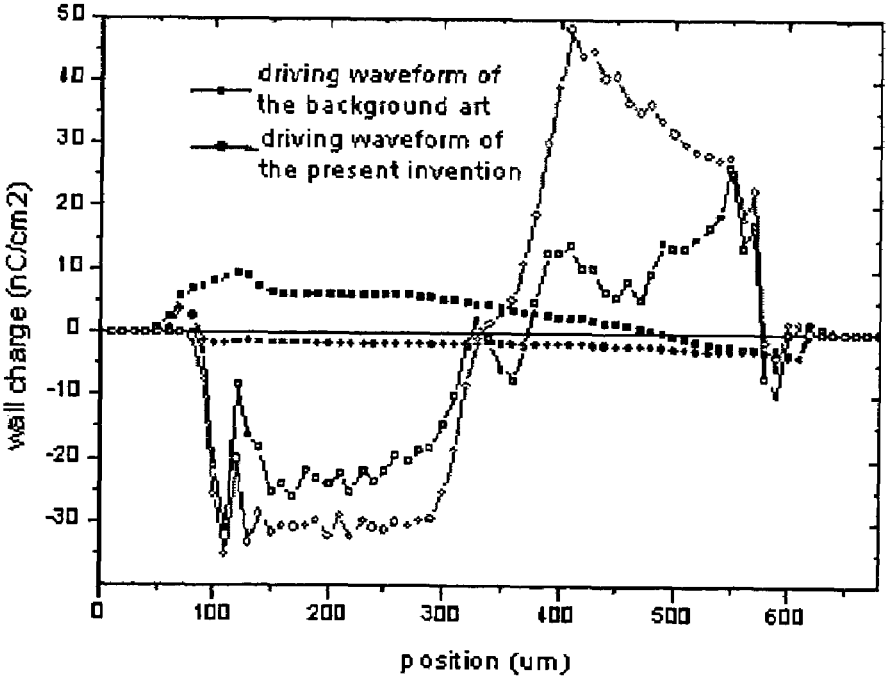

FIG. 9 is a simulation result showing distribution of wall charges formed by an address discharge when a three-electrode AC surface discharge type PDP is driven by the conventional driving waveform as shown in FIG. 4 and FIG. 5 and the driving waveform of the present invention as shown in FIG. 6. In FIG. 9, open symbols whose interior is empty indicate distribution of wall charges in the upper substrate, and closed symbols whose interior is filled indicate distribution of wall charges in the lower substrate. As can be clearly seen from FIG. 9, the amount of wall charges formed after the address discharge becomes a lot when the PDP is driven by the driving waveform of the present invention compared to the conventional driving waveform. Thus, the sustain discharge can occur rapidly and stably. Since the sustain discharge occurs rapidly and stably as such, a driving margin can be secured even at a low gray scale as well as a high gray scale.

Figure 10:
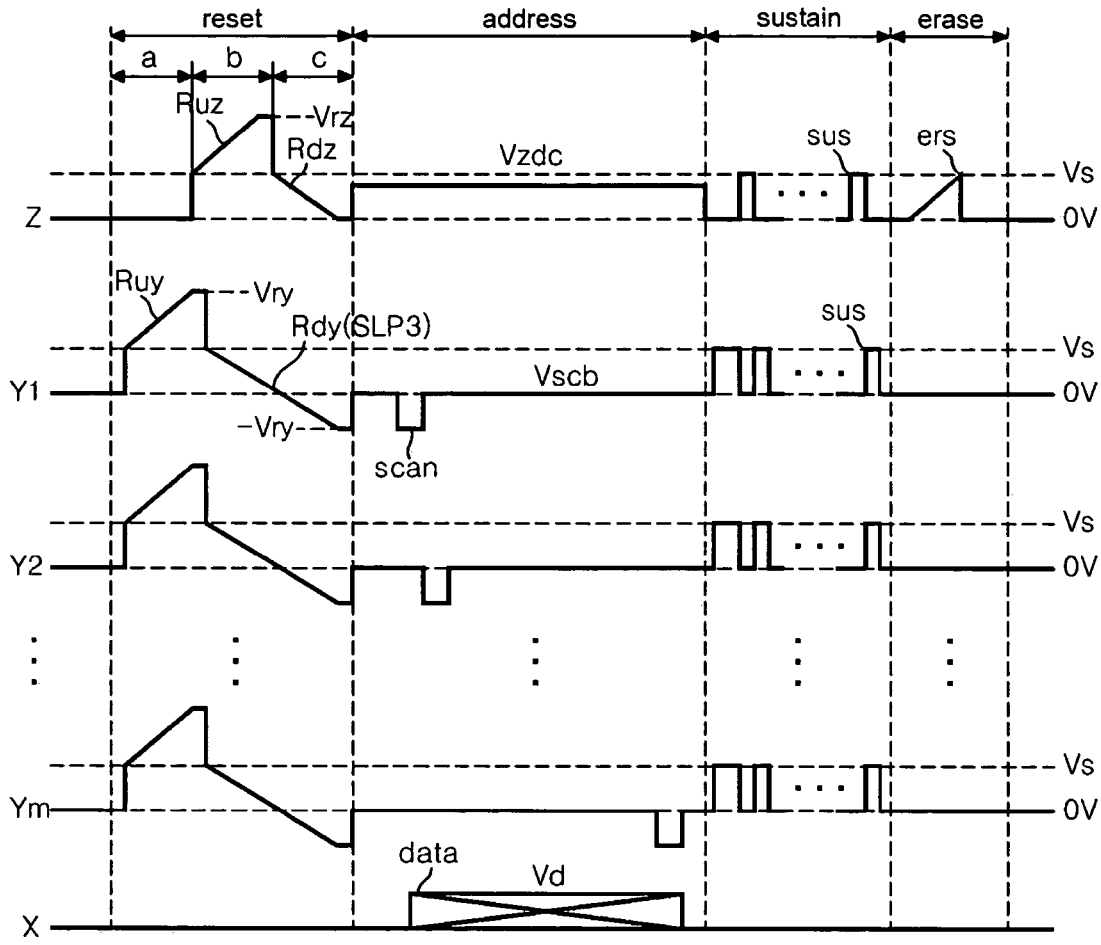
FIG. 10 shows a waveform diagram illustrating a method for driving a plasma display panel according to a second embodiment of the present invention.

FIG. 10 shows a method for driving a PDP according to a second embodiment of the present invention.

Referring to FIG. 10, an "a" period of a reset period is substantially the same as those in FIG. 6 and FIG. 7.

Figure 11:
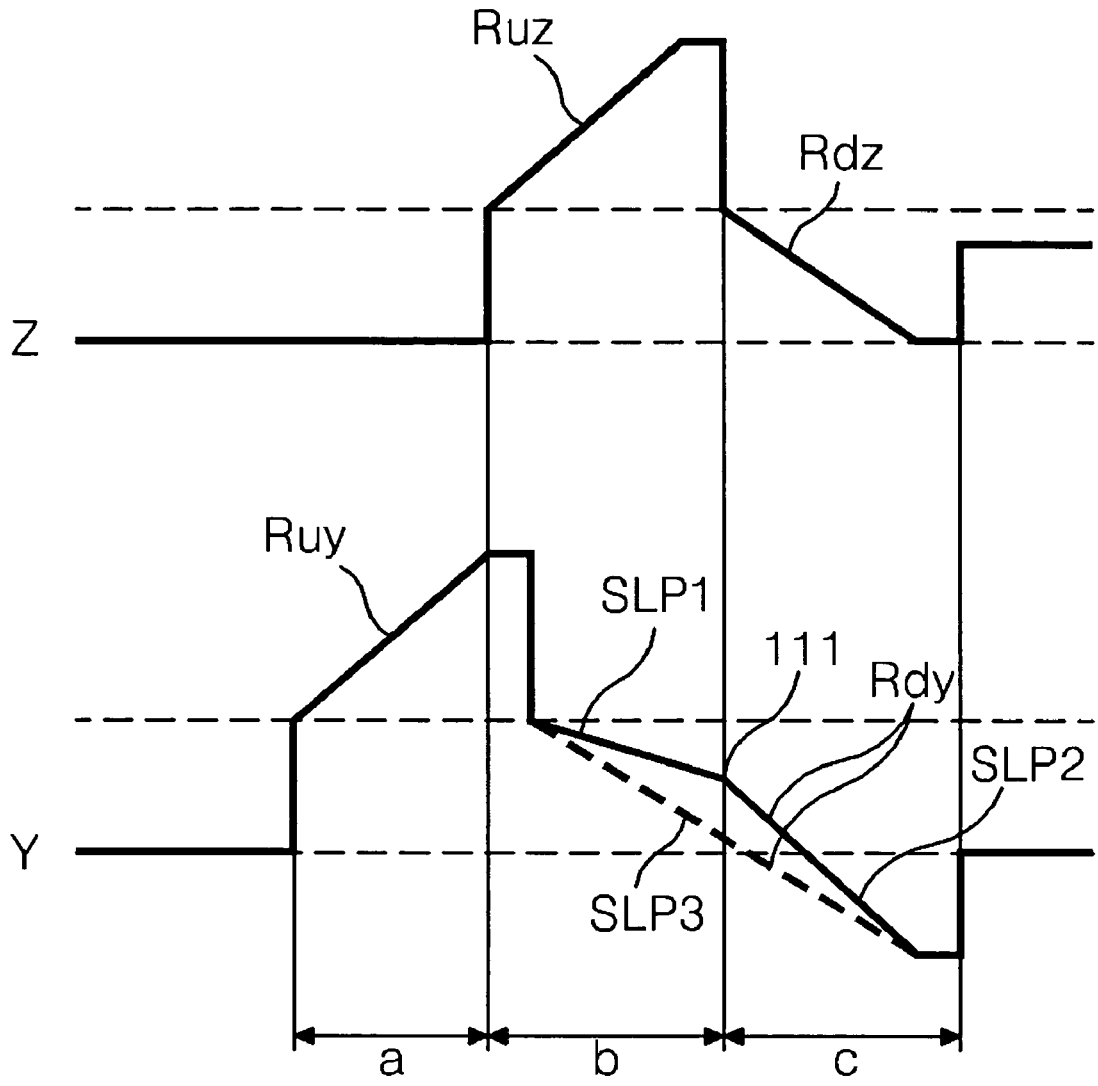
FIG. 11 shows a waveform diagram illustrating expanded initialization waveforms in FIG. 10.

In a "b" period of the reset period, a second ramp-up waveform Ruz whose voltage starts rising approximately from the sustain voltage Vs and then rises up to the setup voltage Vrz is applied to the sustain electrodes Z, and a ramp-down waveform Rdy whose voltage falls approximately from the sustain voltage Vs at a third slope SLP3 is supplied to the scan electrodes Y. Furthermore, during the "b" period, the voltage can fall approximately from the sustain voltage Vs up to a voltage of an inflection point 111 at a first slope SLP1, as shown in FIG. 11. During the "b" period, 0V is applied to the address electrodes X. The "b" period is a period where some of wall charges accumulated on the electrodes Y and Z in the upper substrate are erased and more wall charges are also accumulated on the address electrodes X in the lower substrate. A weak discharge occurs between the sustain electrode Z and the address electrode X and between the scan electrode Y and the sustain electrode Z within cells of the entire screen by means of the second ramp-up waveform Ruz. In this case, since the voltage of the scan electrode Y is lowered by the ramp-down waveform Rdy, a discharge between the scan electrode Y and the sustain electrode Z can easily occur compared to the embodiments of FIG. 6 and FIG. 7. Since the discharge between the scan electrode Y and the sustain electrode Z occurs relatively strongly and stably as such, the driving margin is further expanded.

In a "c" period of the reset period, a ramp-down waveform Rdz whose voltage starts falling approximately from the sustain voltage Vs and then falls down to the ground voltage GND or 0V is supplied to the sustain electrodes Z, and at the same time, a ramp-down waveform Rdy whose voltage continues to fall down to a specific voltage −Vny of the negative polarity at a third slope SLP3 is provided to the scan electrodes Y. Furthermore, during the "c" period, a ramp-down waveform Rdy whose voltage falls from the voltage of the inflection point 111 to a specific voltage −Vny of the negative polarity at a second slope SLP2 as shown in FIG. 11 can be applied to the scan electrodes Y. While the ramp-down waveforms Rdz and Rdy are supplied to the sustain electrodes Z and the scan electrodes Y, the address electrodes X are supplied with 0V. When the ramp-down waveforms Rdz and Rdy are supplied as such, a weak discharge occurs between the scan electrodes Y and the address electrodes X. Excessive wall charges that are not required for the address discharge among the wall charges formed on the scan electrodes Y and the address electrodes X are erased from all the discharge cells by means of the discharge.

The address, period, the sustain period and the erase period are substantially the same as those in FIG. 6 and FIG. 7. Detailed description on them will thus be omitted.

Figure 12:
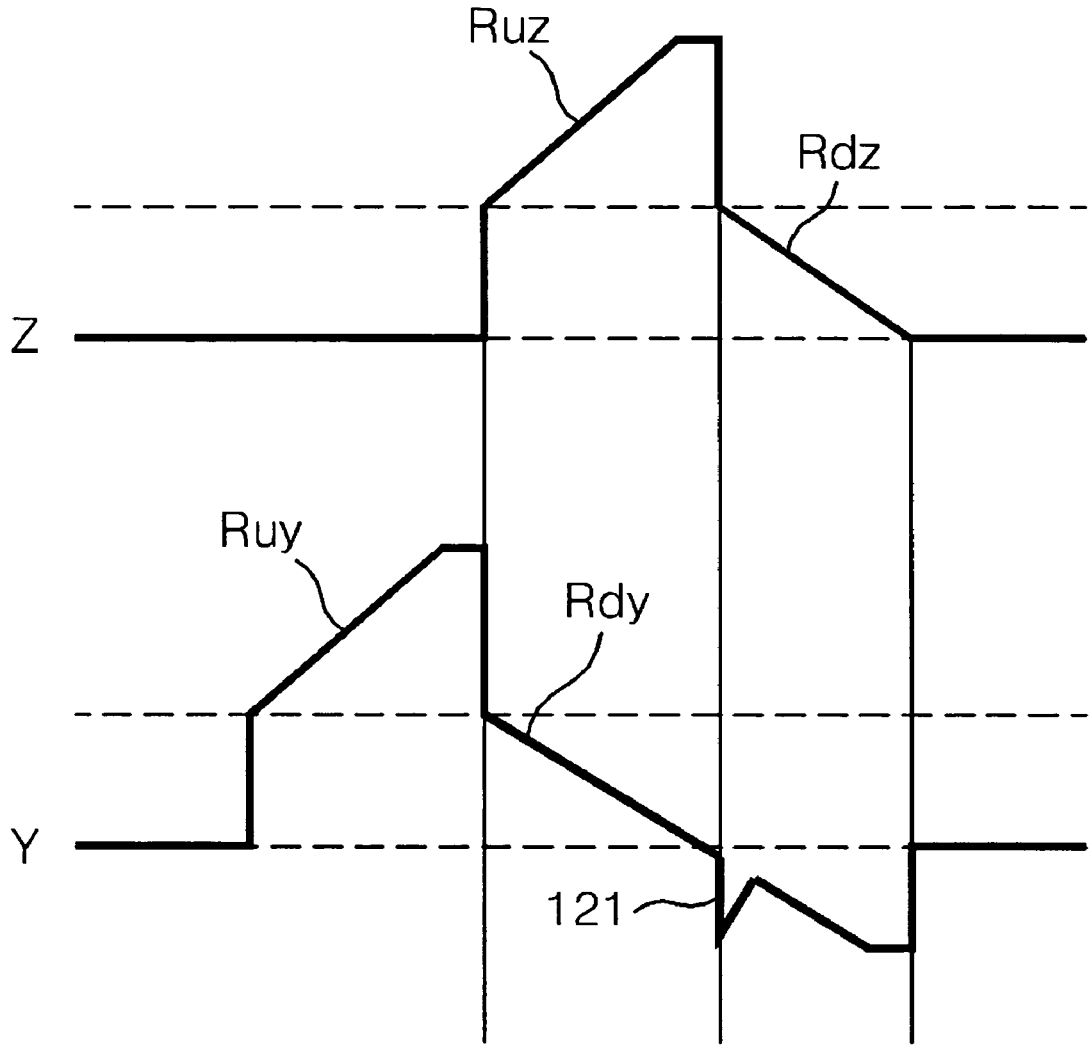
FIG. 12 shows a waveform diagram illustrating variation in voltage that can be represented in the initialization waveforms in FIG. 10.

If the voltage of the sustain electrodes Z varies abruptly when the voltage of the scan electrodes Y is lowered by the ramp-down waveform Rdy as shown in FIG. 10 and FIG. 11, however, the voltage on the scan electrodes Y can drop 121 temporarily due to the coupling between the scan electrodes Y and the sustain electrodes Z, as shown in FIG. 12. Such voltage drop 121 may act as the cause of erroneous discharge.

Figure 13:
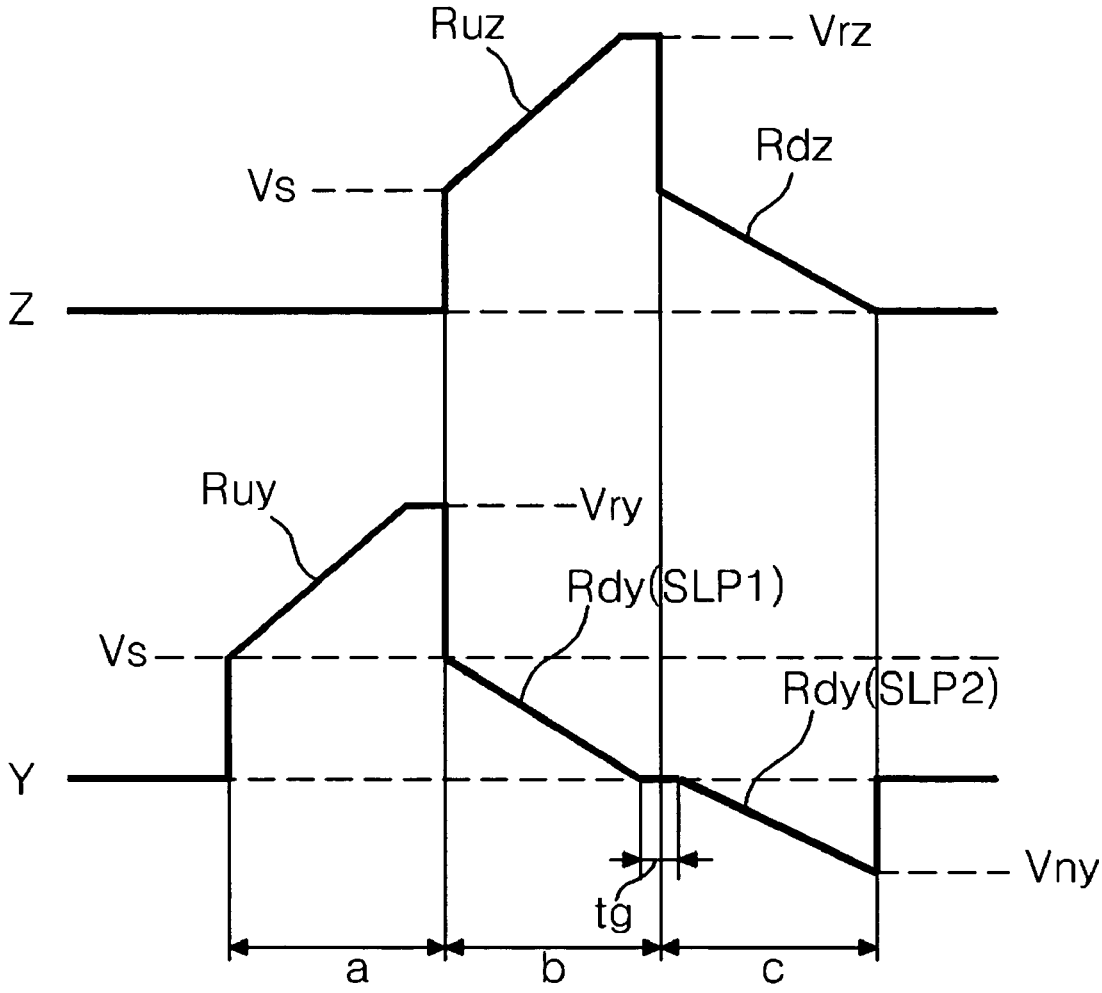
FIG. 13 shows a waveform diagram illustrating a method for driving a plasma display panel according to a third embodiment of the present invention, which shows an initialization waveform generated during a reset period.

FIG. 13 shows a waveform diagram illustrating a method for driving a plasma display panel according to a third embodiment of the present invention, which shows an initialization waveform generated in the reset period.

Referring to FIG. 13, an "a" period of the reset period is substantially the same as those in the aforementioned embodiments.

In a "b" period of the reset period, a ramp-up waveform Ruz whose voltage starts rising from a sustain voltage Vs and then rises up to a setup voltage Vrz is applied to the sustain electrodes Z, and a ramp-down waveform Rdy whose voltage falls from the sustain voltage Vs to the ground voltage GND or 0V at a first tilt SLP1 is supplied to the scan electrodes Y. During the "b" period, the ground voltage GND or 0V is applied to the address electrodes X. The "b" period is a period where some of wall charges accumulated on the electrodes Y and Z in the upper substrate are erased and more wall charges are also accumulated on the address electrodes X in the lower substrate. A weak discharge occurs between the sustain electrode Z and the address electrode X and between the scan electrode Y and the sustain electrode Z within cells of the entire screen by means of the second ramp-up waveform Ruz.

During a period tg between the "b" period and the "c" period of the reset period, the sustain voltage Vs is supplied to the sustain electrodes Z, and the ramp-down waveform Rdz whose voltage falls from the sustain voltage Vs is then applied to the sustain electrodes Z. During the period tg, the ground voltage GND is continually supplied to the sustain electrodes Z. Although the voltage on the sustain electrodes Z abruptly changes, the voltage on the scan electrodes Y is kept as the ground voltage GND since the ground voltage GND is applied to the scan electrodes Y during the period tg. Accordingly, erroneous discharge due to variation in the voltage of the scan electrode Y that may happen due to the abrupt change in the voltage of the sustain electrode Z doe not occur.

In a "c" period of the reset period, a ramp-down waveform Rdz whose voltage starts falling from the sustain voltage Vs and then falls down to the ground voltage GND or 0V is supplied to the sustain electrodes Y, and at the same time, a ramp-down waveform Rdy whose voltage falls from the ground voltage GND to a specific voltage −Vny of the negative polarity at a second tilt SLP2 is provided to the scan electrodes Y. During this period, the ground voltage GND or 0V is supplied to the address electrodes X. When the ramp-down waveforms Rdz and Rdy are supplied as such, a weak discharge occurs between the scan electrodes Y and the address electrodes X. Excessive wall charges that are not required for the address discharge among the wall charges formed on the scan electrodes Y and the address electrodes X are erased from all the discharge cells due to the discharge.

The slopes SLP1 and SLP2 of the ramp-down waveform Rdy that is supplied to the scan electrodes Y during the "b" period and "c" period of the reset period can be set same or different. If the slopes SLP1 and SLP2 of the ramp-down waveform Rdy are differently set during the "b" period and "c" period, it can flexibly cope with a panel characteristic and a driving condition that may vary depending on a model of a PDP.

The address period, the sustain period and the erase period are substantially the same as those in FIG. 6 and FIG. 7. Detailed description on them will thus be omitted.

Figure 14:
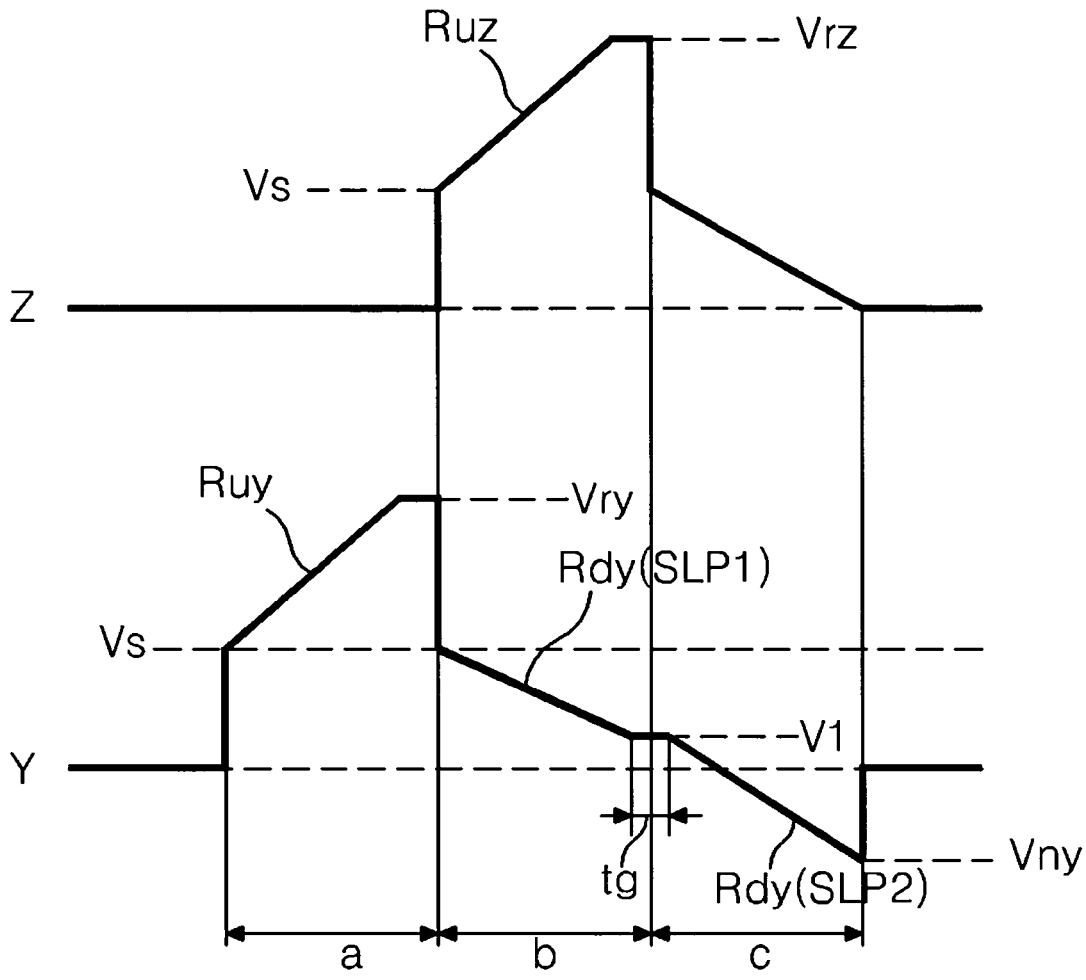
FIG. 14 shows a waveform diagram illustrating a method for driving a plasma display panel according to a fourth embodiment of the present invention, which shows initialization waveforms generated during a reset period.

FIG. 14 shows a waveform diagram illustrating a method for driving a PDP according to a fourth embodiment of the present invention, which shows initialization waveforms generated during the reset period.

Referring to FIG. 14, an "a" period of the reset period is substantially the same as those in the aforementioned embodiments.

In a "b" period of the reset period, a ramp-up waveform Ruz whose voltage rises from a sustain voltage Vs to a setup voltage Vrz is applied to the sustain electrodes Z, and a ramp-down waveform Rdy whose voltage falls from the sustain voltage Vs to an intermediate voltage V1 at a first slope SLP1 is supplied to the scan electrodes Y. The intermediate voltage V1 is set to a voltage that prevents the voltage on the scan electrode Y from changing due to abrupt change in the voltage of the sustain electrode Z and allows a set-down discharge to occur stably considering a panel characteristic and a driving condition of a PDP. The intermediate voltage V1 can be set to a voltage between the sustain voltage Vs and the negative polarity voltage −Vny. For example, the intermediate voltage V1 can be set to an existing scan bias voltage Vscb without adding additional voltage source. During the "b" period, the ground voltage GND or 0V is applied to the address electrodes X. The "b" period is a period where some of wall charges accumulated on the electrodes Y and Z in the upper substrate are erased and more wall charges are accumulated on the address electrodes X in the lower substrate. A weak discharge occurs between the sustain electrode Z and the address electrode X and between the scan electrode Y and the sustain electrode Z within cells of the entire screen by means of the second ramp-up waveform Ruz.

During a period tg between the "b" period and the "c" period of the reset period, the sustain voltage Vs is supplied to the sustain electrodes Z, and the ramp-down waveform Rdz whose voltage falls from the sustain voltage Vs is then applied to the sustain electrodes Z. During the period tg, the ground voltage GND is continually supplied to the sustain electrodes Z. Although the voltage on the sustain electrodes Z abruptly varies, the voltage on the scan electrodes Y is kept as the intermediate voltage V1 since the ground voltage GND is applied to the scan electrodes Y during the period tg. Accordingly, there does not occur erroneous discharge due to a variation in the voltage of the scan electrode Y that may happen due to the abrupt change in the voltage of the sustain electrode Z.

In a "c" period of the reset period, a ramp-down waveform Rdz whose voltage starts falling from the sustain voltage Vs and then falls down to the ground voltage GND or 0V is supplied to the sustain electrodes Y, and at the same time, a ramp-down waveform Rdy whose voltage falls from the ground voltage GND to a specific voltage −Vny of the negative polarity at a second tilt SLP2 is applied to the scan electrodes Y. During this period, the ground voltage GND or 0V is supplied to the address electrodes X. When the ramp-down waveforms Rdz and Rdy are supplied as such, a weak discharge occurs between the scan electrodes Y and the address electrodes X. Excessive wall charges that are not required for the address discharge among the wall charges formed on the scan electrodes Y and the address electrodes X are erased from all the discharge cells by means of the discharge.

The slopes SLP1 and SLP2 of the ramp-down waveform Rdy supplied to the scan electrodes Y during the "b" and "c" periods of the reset period can be set same or different. If the slopes SLP1 and SLP2 of the ramp-down waveform Rdy are set differently in the "b" and "c" periods, it can flexibly cope with a panel characteristic and a driving condition that may vary depending on a model of a PDP.

The address period, the sustain period and the erase period are substantially the same as those in FIG. 6 and FIG. 7. Detailed description on them will thus be omitted.

Figure 15:
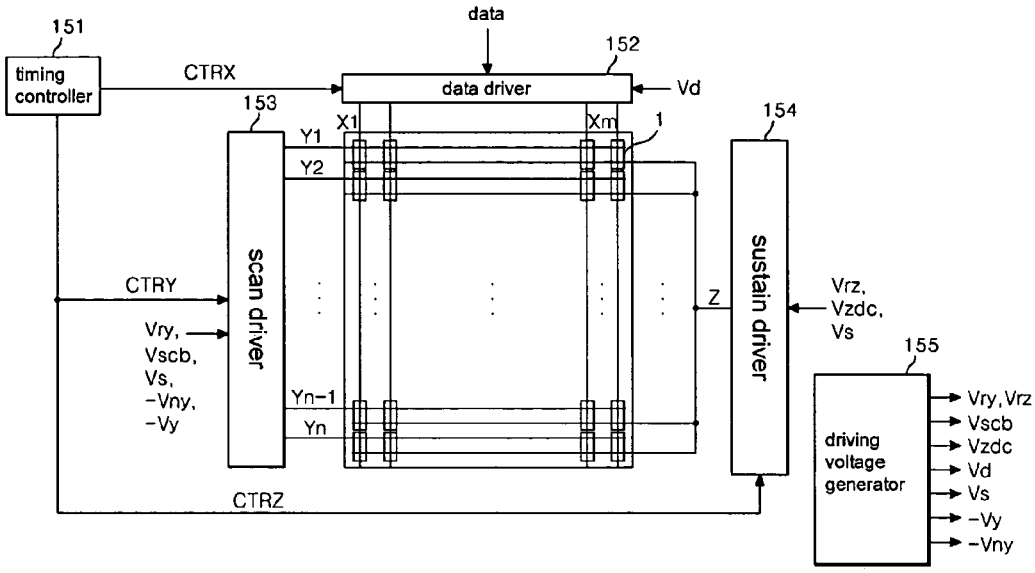
FIG. 15 is a block diagram showing an apparatus for driving a plasma display panel according to an embodiment of the present invention.

FIG. 15 is a block diagram showing an apparatus for driving a plasma display panel according to an embodiment of the present invention.

Referring to FIG. 15, the apparatus for driving the PDP according to an embodiment of the present invention includes a data driver 152 for supplying data to address electrodes X1 to Xm, a scan driver 153 for driving scan electrodes Y1 to Yn, a sustain driver 154 for driving a sustain electrodes Z as a common electrode, a timing controller 151 for controlling the respective drivers 152, 153 and 154, and a driving voltage generator 155 for supplying a driving voltage necessary for each of the drivers 152, 153 and 154.

The data driver 152 is supplied with data that are inverse-gamma corrected and error-diffused by an inverse gamma correction circuit, an error diffusion circuit, etc. (not shown) and are then mapped to respective sub-fields by means of a sub-field mapping circuit. The data driver 152 serves to sample and latch the data in response to a timing control signal CTRX from the timing controller 151 and then supply the data to the address electrodes X1 to Xm.

The scan driver 153 supplies initialization waveforms as shown in FIG. 6, FIG. 10 to FIG. 14 to the scan electrodes Y1 to Yn under the control of the timing controller 151 during a reset period. Further, the scan driver 153 sequentially supplies a scan pulse to the scan electrodes Y1 to Yn during an address period and then supplies a sustain pulse sus to the scan electrodes Y1 to Yn during the sustain period, under the control of the timing controller 151.

The sustain driver 154 supplies the initialization waveforms as shown in FIG. 6, FIG. 10 to FIG. 14 to the sustain electrodes Z under the control of the timing controller 151 during the reset period. Moreover, the sustain driver 154 constantly supplies a DC voltage Vzdc lower than the sustain voltage Vs to the sustain electrodes Z during the address period, and then supplies the sustain pulse sus to the sustain electrodes Z during the sustain period, while operating in turn together with the scan driver 153, under the control of the timing controller 151.

The timing controller 151 controls the respective drivers 152, 153 and 154 by receiving a vertical/horizontal synchronization signal and a clock signal, generating timing control signals CTRX, CTRY and CTRZ required for the respective drivers, and then supplying the timing control signals CTRX, CTRY and CTRZ to corresponding drivers 152, 153 and 154. The data control signal CTRX contains a sampling clock for sampling data, a latch control signal, and a switch control signal for controlling on/off time of an energy recovery circuit and a driving switching element. The scan control signal CTRY contains a switch control signal for controlling on/off time of an energy recovery circuit and a driving switching element in the scan driver 153. The sustain control signal CTRZ contains a switch control signal for controlling on/off time of an energy recovery circuit and a driving switching element in the sustain driver 154.

The driving voltage generator 155 generates voltages Vry and Vrz of ramp-up waveforms Ruy and Ruz, a voltage −Vny of a ramp-down waveform Rdy, a DC voltage Vzdc applied to the sustain electrodes Z during the address period, a scan bias voltage Vscb, a scan voltage −Vy, a sustain voltage Vs, a data voltage Vd and the like. These driving voltages may vary depending on the composition of a discharge gas or the structure of a discharge cell.

Figure 16:
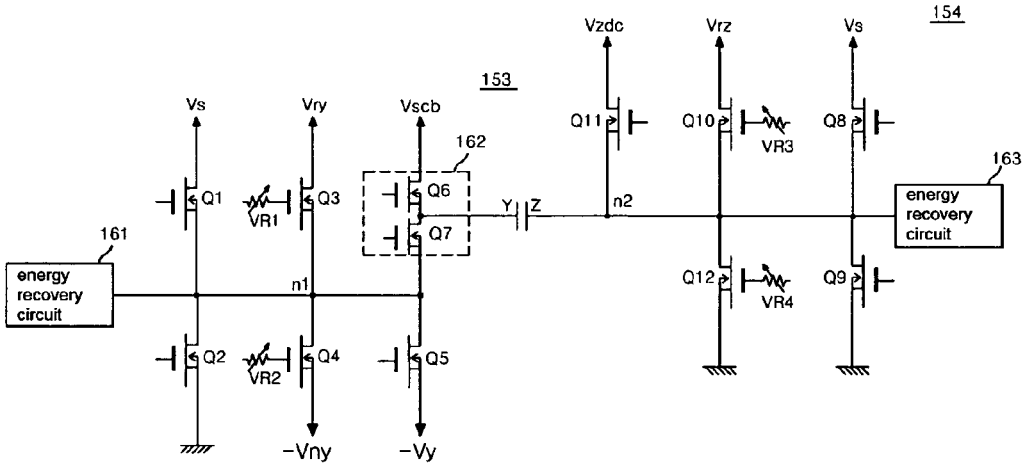
FIG. 16 is a circuit diagram showing in detail a scan driver and a sustain driver shown in FIG. 15.
Figure 17:
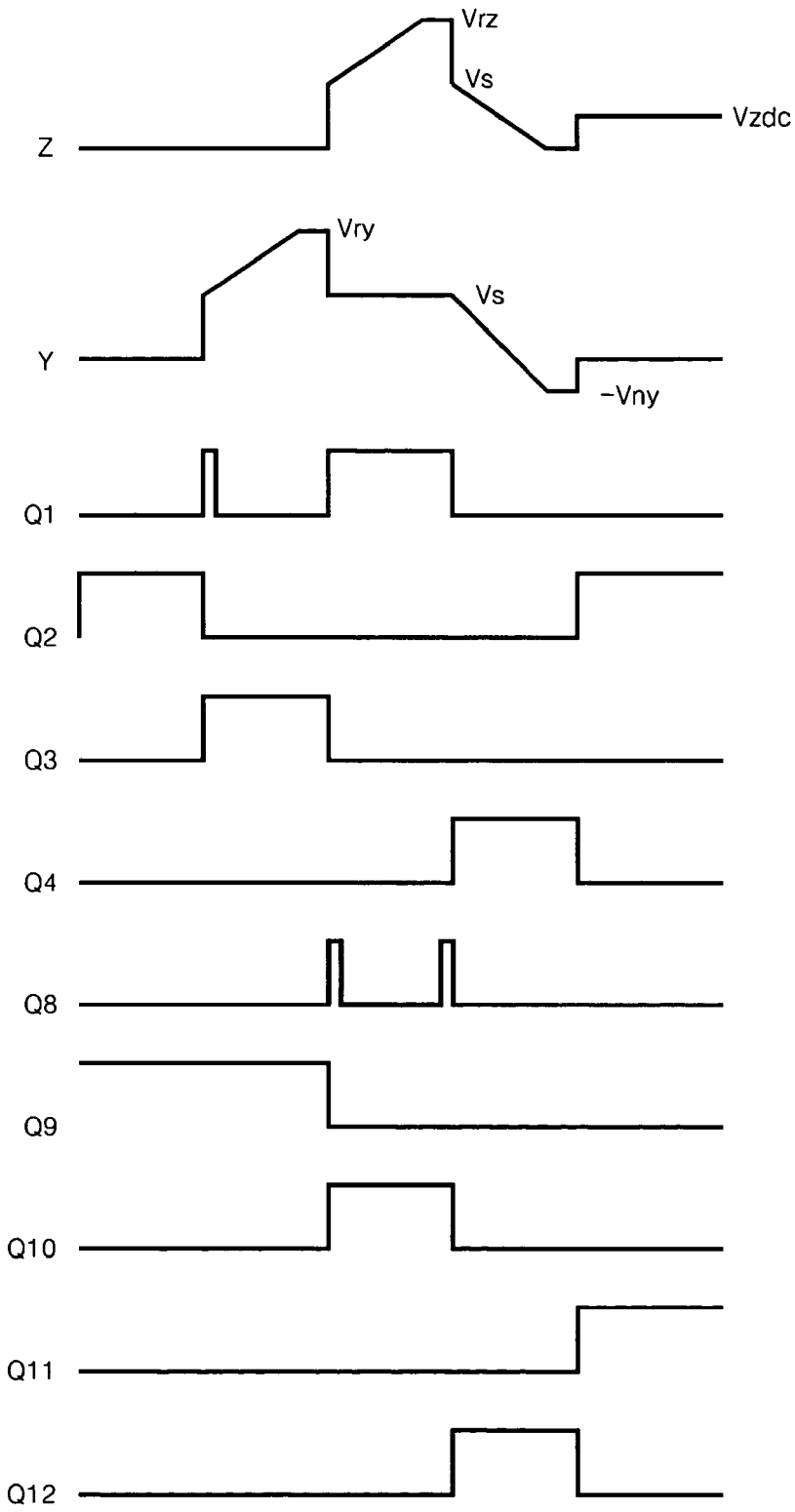
FIG. 17 shows a waveform diagram illustrating the operation of the switching elements shown in FIG. 16 in order to generate driving signals as in FIG. 6.
Figure 18:
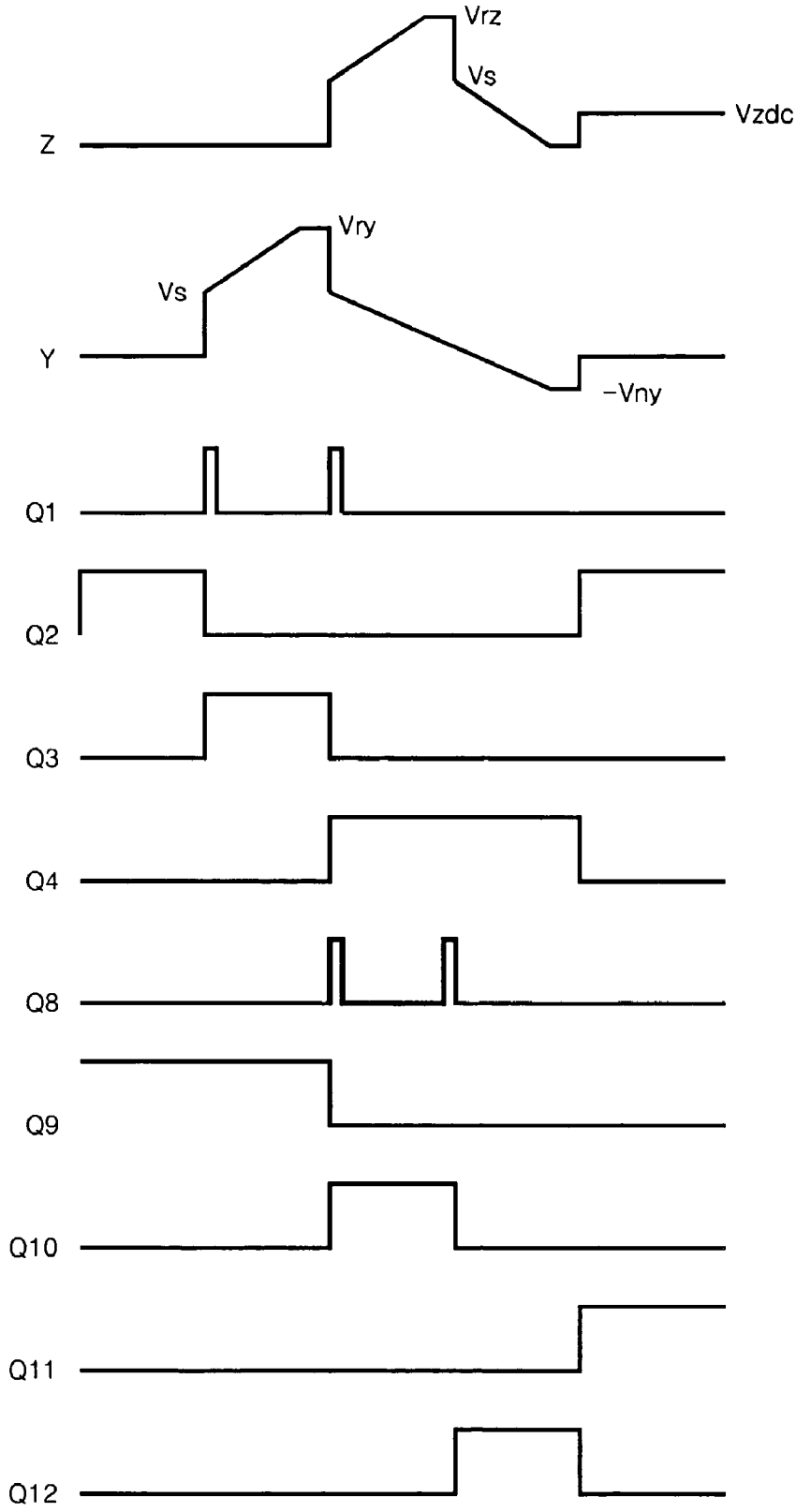
FIG. 18 shows a waveform diagram illustrating the operation of the switching elements shown in FIG. 16 in order to generate driving signals as in FIG. 10.
Figure 19:
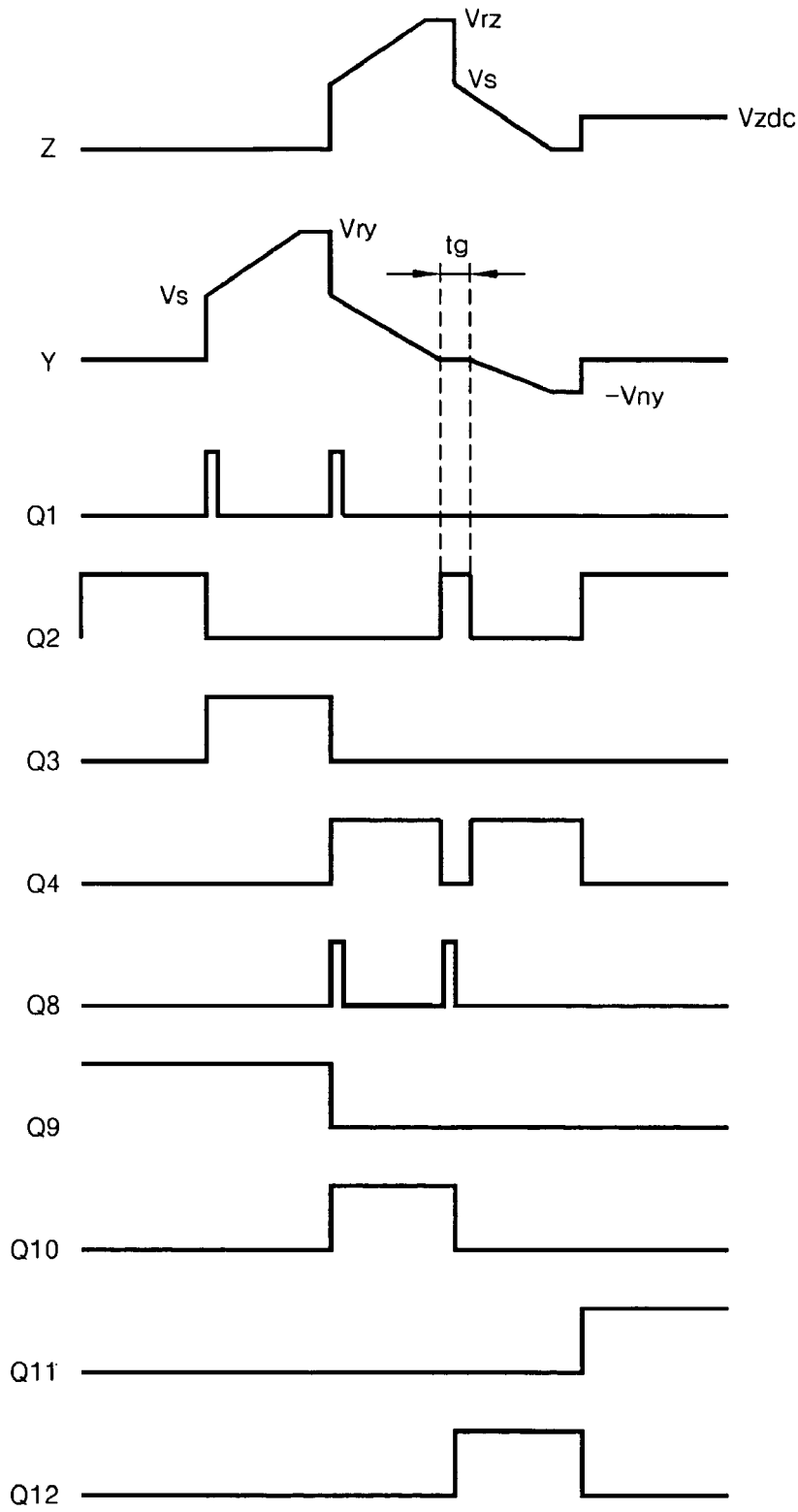
FIG. 19 shows a waveform diagram illustrating the operation of the switching elements shown in FIG. 16 in order to generate driving signals as in FIG. 13.
Figure 20:
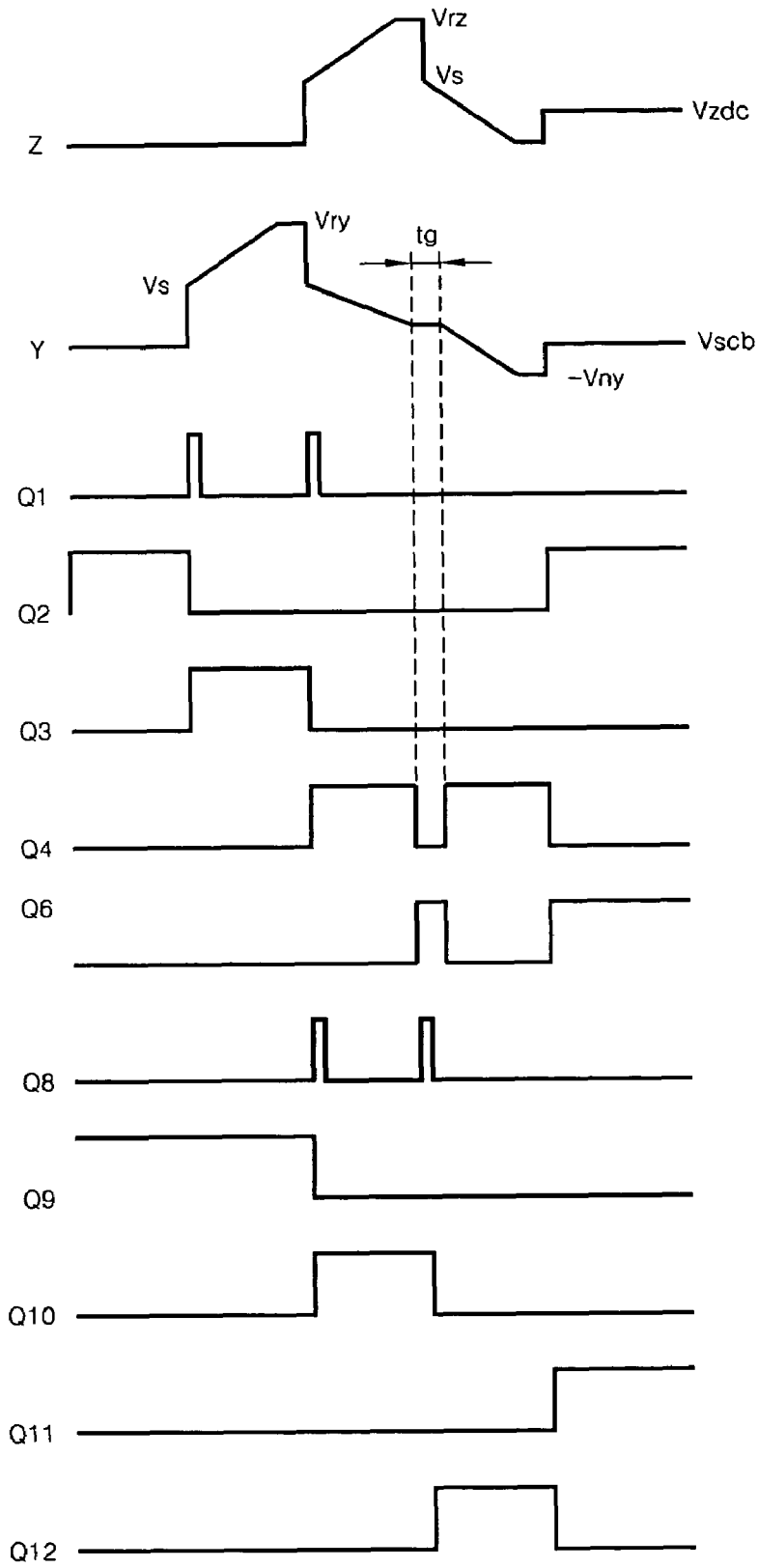
FIG. 20 shows a waveform diagram illustrating the operation of the switching elements shown in FIG. 16 in order to generate driving signals as in FIG. 14.

FIG. 16 is a circuit diagram showing in detail a part of the scan driver 153 and the sustain driver 154 for driving a pair of the scan electrode Y and the sustain electrode Z.

Referring to FIG. 16, the scan driver 153 includes an energy recovery circuit 161, a driving switch circuit 162, and first to fifth switching elements Q1 to Q5.

The energy recovery circuit 161 recovers energy of an ineffective power that does not contribute to discharge in a PDP from the scan electrode Y and has the scan electrode Y charged with the recovered energy. The energy recovery circuit 161 can be any one of known energy recovery circuits.

The driving switch circuit 162 includes sixth and seventh switching elements Q6 and Q7 connected between a scan bias voltage source Vscan-com and a first node n1 in a push-pull type. An output terminal between the sixth and seventh switching elements Q6 and Q7 is connected to a scan electrode Y. Each of the sixth and seventh switching elements Q6 and Q7 supplies the scan bias voltage Vscb or a voltage on the first node n1 to the scan electrodes Y under the control of the timing controller 151.

The first switching element Q1 is connected between the sustain voltage source Vs and the first node n1 and supplies the sustain voltage Vs to the first node n1 under the control of the timing controller 151.

The second switching element Q2 is connected between the ground voltage GND and the first node n1 and supplies the ground voltage GND to the first node n1 under the control of the timing controller 151.

The third switching element Q3 is connected between the ramp-up voltage source Vry and the first node n1 and supplies the first ramp-up waveform Ruy to the first node n1 at a slope that is determined according to a predetermined RC time constant under the control of the timing controller 151. To a control terminal of the third switching element Q3 is connected a variable resistor VR1 for controlling the slope of the first ramp-up waveform Ruy and a capacitor (not shown).

The fourth switching element Q4 is connected between the ramp-down voltage source −Vny and the first node n1 and supplies the first ramp-down waveform Rdy to the first node n1 at a slope decided according to a predetermined RC time constant under the control of the timing controller 151. To a control terminal of the fourth switching element Q4 is connected a variable resistor VR2 for controlling the slope of the first ramp-down waveform Rdy and a capacitor (not shown).

The fifth switching element Q5 is connected between the scan voltage source Vscan and the first node n1 and supplies the scan voltage −Vy to the first node n1 under the control of the timing controller 151.

The sustain driver 154 includes an energy recovery circuit 163, and eighth to twelfth switching elements Q8 to Q12.

The energy recovery circuit 163 recovers energy of an ineffective power that does not contribute to discharge in the PDP from the sustain electrode Z and has the sustain electrode Z charged with the recovered energy. The energy recovery circuit 163 can be any known energy recovery circuit.

The eighth switching element Q8 is connected between the sustain voltage source Vs and the second node n2 and supplies the sustain voltage Vs to the second node n2, i.e., the sustain electrode Z under the control of the timing controller 151.

The ninth switching element Q9 is connected between the ground voltage GND and the second node n2 and supplies the ground voltage GND to the second node n2 under the control of the timing controller 151.

The tenth switching element Q10 is connected between a ramp-up voltage source Vrz and the second node n2 and supplies a second ramp-up waveform Ruz to the second node n2 at a slope decided according to a predetermined RC time constant under the control of the timing controller 151. To a control terminal of the tenth switching element Q10 is connected a variable resistor VR3 for controlling the slope of the second ramp-up waveform Ruz and a capacitor (not shown).

The eleventh switching element Q11 is connected between a DC voltage source Vzdc lower than the sustain voltage Vs and the second node n2 and supplies the DC voltage Vzdc to the second node n2 during the address period under the control of the timing controller 151.

The twelfth switching element Q12 is connected between the ground voltage GND and the second node n2 and supplies a second ramp-down waveform Rdz to the second node n2 at a slope decided according to a predetermined RC time constant under the control of the timing controller 151. To a control terminal of the twelfth switching element Q12 is connected a variable resistor VR4 for controlling the slope of the second ramp-down waveform Rdz and a capacitor (not shown).

FIG. 17 to FIG. 20 show timing control signals applied to the switching elements when the driving waveforms disclosed in the aforementioned embodiments are generated.

As described above, according to a method for driving a PDP and apparatus thereof of the present invention, a ramp-up waveform is sequentially applied to a scan electrode and a sustain electrode and at the same time, a ramp-down waveform is applied to the scan electrode and the sustain electrode, thus initializing the whole cell. At this time, an "a" period where a first ramp-up waveform is applied to the scan electrode is a period where wall charges are formed on an upper substrate and a lower substrate, and a "b" period where a second ramp-up waveform is applied to the sustain electrode is a period where the wall charges of the upper substrate are erased. Further, a "c" period where the ramp-down waveform is simultaneously applied to the scan electrode and the sustain electrode is a period where the wall charges of the upper substrate and the lower substrate are adequately erased. Moreover, according to the method for driving the PDP and apparatus thereof of the present invention, when a voltage of the sustain electrode varies abruptly, the voltage of the scan electrode is fixed to a given voltage. Before and after a period where the voltage of the scan electrode is fixed, the slope the initialization waveform applied to the scan electrode can be set differently so that discharge of the reset period is optimally stabilized according to a panel characteristic and a driving condition of the PDP.

A method for driving a PDP and apparatus thereof according to the present invention has the following effects due to the above initialization operation. Firstly, it is possible to prevent erroneous discharge due to a temporary voltage drop. Secondly, a ramp voltage is lowered to improve contrast characteristics. Thirdly, wall charges of an upper substrate and a lower substrate can be easily controlled and stable wall charges can be formed in an address initial condition. It is thus possible to widen the driving margin of the address operation. Fourthly, a sufficient amount of wall charges are constantly formed on the lower substrate in an address initial condition to reduce address discharge delay, i.e., an address jitter. It is thus possible to drive a PDP in a single scan. Furthermore, according to the present invention, address discharge is formed rapidly and strongly and the amount of wall charges on the upper substrate formed by the address discharge is increased. A sustain discharge occurs rapidly and stably. Therefore, the sustain operation is stabilized and a sustain driving margin is widened.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for driving a plasma display panel by dividing at least one subfield into a reset period, an address period and a sustain period, comprising:

an initialization driving circuit for generating a ramp waveform whose voltage varies and that includes a maintenance period of the reset period where a specific voltage is maintained for a predetermined time period between first and second periods of the reset period, and changing a voltage supplied to a sustain electrode during the maintenance period of the reset period, wherein the initialization driving circuit supplies a first ramp-up waveform whose voltage increases to the scan electrode during the first period of the reset period, supplies the specific voltage to the scan electrode and at a same time supplies a second ramp-up waveform whose voltage increases to the sustain electrode during the maintenance period of the reset period, and supplies a first ramp-down waveform and a second ramp-down waveform whose voltages decrease to the scan electrode and the sustain electrode, respectively, during the second period of the reset period.

2. The apparatus of claim 1, wherein the specific voltage is a ground voltage GND.

3. The apparatus of claim 2, wherein the ramp waveform has a voltage that decreases from a voltage of a positive polarity to a voltage of a negative polarity via the ground voltage GND.

4. The apparatus of claim 1, wherein the specific voltage is a voltage between the voltage of the positive polarity and the voltage of the negative polarity.

5. The apparatus of claim 4, wherein the specific voltage is a voltage having a same magnitude as a voltage supplied during the sustain period.

6. The apparatus of claim 4, wherein the specific voltage is a voltage having a magnitude between a voltage supplied during the sustain period and a ground voltage GND.

7. The apparatus of claim 1, wherein the specific voltage is a voltage having a same magnitude as a voltage supplied during the sustain period.

8. The apparatus of claim 1, wherein the specific voltage is a voltage having a magnitude between a voltage supplied during the sustain period and a ground voltage GND.

9. A method for driving a plasma display panel by dividing at least one subfield into a reset period, an address period and a sustain period, the method comprising:

supplying a first ramp-up waveform whose voltage increases to a scan electrode during a first period of the reset period;

supplying a second ramp-up waveform whose voltage increases to a sustain electrode and at a same time, supplying a first ramp-down waveform to the scan electrode during a second period of the reset period; and supplying the first ramp-down waveform to the scan electrode successively and at the same time, supplying a second ramp-down waveform whose voltage decreases to the sustain electrode during a third period of the reset period.

10. An apparatus for driving a plasma display panel by dividing at least one subfield into a reset period, an address period and a sustain period, comprising:

an initialization driving circuit for supplying a first ramp-up waveform whose voltage increases to a scan electrode during a first period of the reset period, supplying a second ramp-up waveform whose voltage increases to a sustain electrode and at a same time, supplying a first ramp-down waveform to the scan electrode during a second period of the reset period, and, supplying the first ramp-down waveform to the scan electrode successively and at the same time, supplying a second ramp-down waveform whose voltage decreases to the sustain electrode during a third period of the reset period.

* * * * *